United States Patent [19]

Palma

[11] 4,218,021

[45] Aug. 19, 1980

[54] ELECTROMAGNETIC FUEL INJECTOR

[75] Inventor: James D. Palma, Grand Rapids, Mich.

[73] Assignee: General Motors Corporation, Detroit, Mich.

[21] Appl. No.: 941,754

[22] Filed: Sep. 13, 1978

Related U.S. Application Data

[63] Continuation-in-part of Ser. No. 838,468, Oct. 3, 1977, abandoned.

[51] Int. Cl.[2] ..... B05B 1/30

[52] U.S. Cl. ..... 239/585; 251/84

[58] Field of Search ..... 239/533.3–533.1 L, 239/585, 583; 251/139, 140, 141, 84, 159, 170

[56] References Cited

U.S. PATENT DOCUMENTS

| | | | |
|---|---|---|---|
| 1,504,773 | 8/1924 | Marston | 239/585 X |
| 1,664,612 | 4/1928 | French | 239/585 |
| 3,048,188 | 8/1962 | Hunter | 251/84 X |
| 3,126,158 | 3/1964 | Dreisin . | |
| 3,653,630 | 4/1972 | Ritsema | 251/141 X |
| 3,731,881 | 5/1973 | Dixon et al. | 251/139 |

*Primary Examiner*—Robert B. Reeves

*Assistant Examiner*—Gene A. Church

*Attorney, Agent, or Firm*—A. N. Krein

[57] ABSTRACT

An electromagnetic fuel injector for use in a spark ignition internal combustion engine and, in particular, for use in a low pressure, throttle body fuel injection system for such an engine. The fuel injector includes an electromagnet actuated valve having a semi-spherical seating surface thereon for cooperation with an annular valve seat at one end of a nozzle assembly for controlling the injection flow of fuel from the injector and a flat surface for abutment against the end of the armature of an electromagnet. This valve is biased toward a closed position in seating engagement against the valve seat by a spring associated with the armature and is biased toward an open position relative to the valve seat by an opposed spring upon energization of the electromagnet. The electromagnet structure includes a small diameter axial extending small diameter guide pin slidably received in a guide bore of the armature for reducing sliding friction of the armature. In a preferred enbodiment the nozzle assembly is threaded into the injector body to abut against a deformable abutment shoulder whereby the stroke of the armature-valve can be adjusted.

15 Claims, 9 Drawing Figures

ELECTROMAGNETIC FUEL INJECTOR

FIELD OF THE INVENTION

This application is a continuation-in-part of my copending Application Ser. No. 838,468, filed Oct. 3, 1977 now abandoned.

This invention relates to fuel injectors and, in particular, to an electromagnetic fuel injector for use in injecting fuel, such as gasoline at a low supply pressure, into an internal combustion engine.

DESCRIPTION OF THE PRIOR ART

Various types of electromagnetic fuel injectors are known in the art. Normally such injectors contain an electromagnetic coil which, when energized, is operative to effect axial movement of an armature. Normally the armature is mechanically connected to a valve that is movable relative to a valve seat for controlling fuel injection.

Such injectors normally require very close manufacturing tolerances to obtain concentricity of parts for effecting proper seating of the valve, for proper stroke length of the armature/valve combination and to obtain other desired structural relationships effecting fuel metering, fuel spray patterns and the durability of the injector. Most such prior art electromagnetic fuel injectors normally operate with a relatively slow dynamic response time.

SUMMARY OF THE INVENTION

A primary object of the present invention is to provide an improved injector construction for a gasoline engine that advantageously utilizes a relatively low pressure gasoline source, such as 10 psi, to provide rapid and positive variably injector open times with a minimum electrical energy requirement and including a two part movable unit with an unsecured seating fit and so constructed and arranged that the parts can shift relative to each other to provide self alignment and can operate for a prolonged time without undue wear, leakage, etc.

Accordingly, another object of the invention is to provide an improved electromagnetic fuel injector that is operative for use in a low pressure gasoline fuel injection system, the injector having a fast response time and being operative to effect good atomization of the fuel being discharged at low pressure therefrom.

Another object of this invention is to provide an improved electromagnetic fuel injector having a valve seat, swirl director and swirl chamber means in an injection nozzle tip assembly therefor which is axially adjustable in the housing of the injector whereby to regulate the stroke of the spring-biased armature of the electromagnetic for controlling movement of a valve relative to the valve seat.

A further object of the invention is to provide an improved electromagnetic fuel injector wherein the armature of the electromagnetic assembly of the injector has an axial bore therethrough to receive a fixed small diameter guide pin whereby the axial sliding friction of the armature is substantially reduced so as to improve the dynamic response time of the injector.

Still another object of the present invention is to provide an improved electromagnetic fuel injector wherein a separate valve member has a flat on one side thereof for abutment against the flat end of the spring-biased armature of a solenoid actuator, the valve having an intermediate semispherical seating surface for cooperation with an annular valve seat and with a second spring abutting the valve on the side opposite the flat whereby the valve member is self-centering without generating bounce problems.

Still another object of the present invention is to provide an injector apparatus of the above type which includes feature of construction, operation and arrangement, rendering it easy and inexpensive to manufacture and to calibrate for desired fuel flow, which is reliable in operation, and in other respects suitable for use on production motor vehicle fuel systems.

The present invention provides an electromagnetic fuel injector that is operative when supplied with fuel at, for example, 6 psi to 15 psi, the injector having a housing with a nozzle assembly incorporated at one end therein. In the preferred forms herein disclosed, this nozzle assembly includes a seat element having a conical valve seat encircling a vertical discharge passage through the seat element, a swirl director plate having a plurality of radial downwardly extending passages therethrough for directing fuel from the discharge passage into a swirl chamber-outlet orifice passage in the spray tip of the nozzle assembly. The movable unit is defined by a spherical bearing having a flat face which is seated on the flat end face of an armature but is not otherwise secured thereto and thus can slide sideways to accommodate misalignment. The armature is spring-biased towards a valve-closed position and is drawn against the bias by current flow in the solenoid. The armature, in the most preferred form, is guided by a small diameter guide pin for axial movement. The armature, under the spring bias, locates the valve in a closed, centered position on the valve seat. A second spring located in the discharge passage of the seat element biases the spherical bearing towards the valve open position and acts in holding the bearing against the armature when the solenoid is energized and the valve opened. In a preferred embodiment, means are provided on the nozzle assembly and housing whereby the stroke of the armature can be adjusted to regulate metering of fuel.

For a better understanding of the invention, as well as other objects and further features thereof, reference is had to the following detailed description of the invention to be read in connection with the accompanying drawings.

DESCRIPTION OF THE EMBODIMENTS

Figure 1:
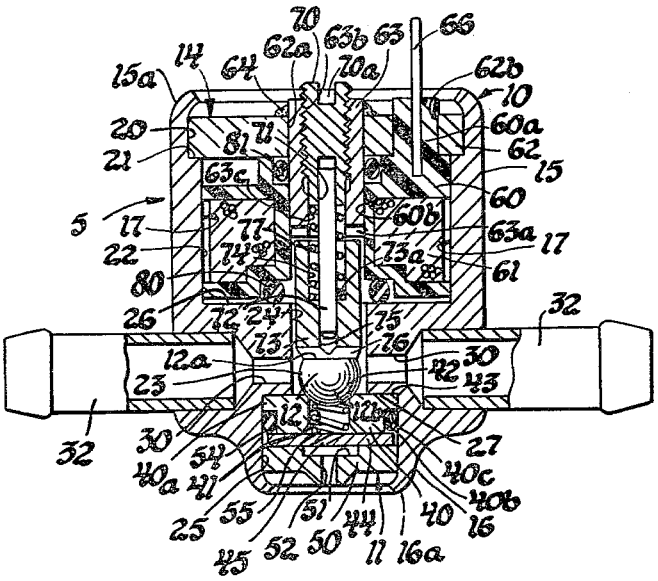
FIG. 1 is a longitudinal, cross sectional view of a first embodiment of an electromagnetic fuel injector constructed in accordance with the invention, showing the armature guide pin and valve member thereof in elevation.

Referring now to the drawings, an electromagnetic fuel injector, generally designated 5 in accordance with an embodiment of the invention, includes as major components thereof a body 10, a nozzle assembly 11, a valve 12 and a solenoid assembly 14 used to control movement of the valve 12.

Figure 4:
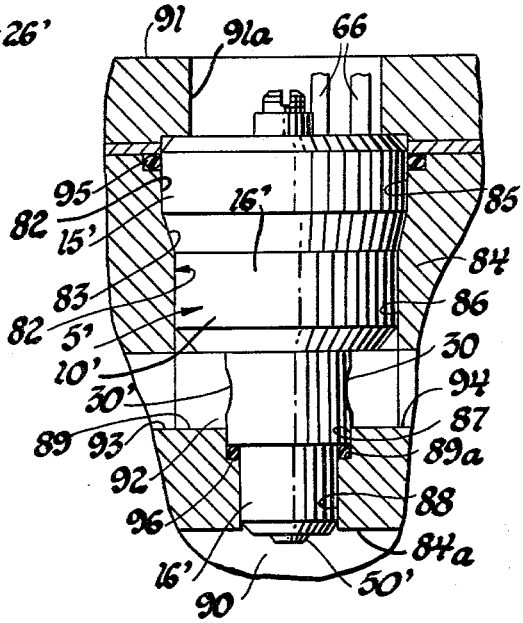
FIG. 4 is a view in elevation of the injector of FIG. 2 shown mounted in the socket of an injector mechanism, shown in elevational cross section, for a spark ignition, internal combustion engine.

Referring now to FIG. 1, in the construction illustrated, the body 10, made for example of silicon core iron and which is cold formed, is of circular hollow tubular configuration and is of such external shape so as to permit direct insertion, if desired, of the injector into a socket provided for this purpose in either an intake manifold, not shown, or in the injector mechanism of a throttle body injection apparatus, for an engine in a manner similar to that shown in FIG. 4 and described hereinafter.

The body 10, with particular reference first to FIG. 1, includes an enlarged upper solenoid case portion 15 and a lower end nozzle case portion 16 of reduced external diameter relative to portion 15. An internal cylindrical cavity 17 is formed in the body 10 by a stepped vertical bore therethrough that is substantially coaxial with the axis of the body. In the construction shown in FIG. 1, the cavity 17 provides a cylindrical upper wall 20, a cylindrical upper intermediate wall 22, a cylindrical lower intermediate wall 24 and a cylindrical lower wall 25. Such walls 20, 22 and 24 are of progressively reduced diameters relative to the wall next above, while the lower wall 25 is of enlarged diameter relative to wall 24 for a purpose to be described. Walls 20 and 22 are interconnected by a flat shoulder 21. Walls 22 and 24 are interconnected by a flat shoulder 26. Walls 24 and 25, in the construction shown in FIG. 1, are interconnected by a flat shoulder 27.

Wall 24 defines the outer peripheral extent of a fuel chamber 23, to be described in greater detail hereinafter, within the body 10. The body 10 in the construction shown in FIG. 1, is provided with through radial port passages 30 in the nozzle case portion 15 thereof which open through the wall 24 to effect flow communication with the fuel chamber 23.

Although the body 10, as previously described, is preferably constructed for insertion into a suitable socket provided, for example, in the injector mechanism of a throttle body injection apparatus, if desired and as shown in FIG. 1, hose coupling tubes 32 may be connected as by a press fit to the enlarged diameter outer end portions of the port passages 30, whereby this electromagnetic fuel injector 5 can be interconnected at opposite sides with a suitable fuel hose conduits, not shown, of the fuel system for an engine. In the construction shown in FIG. 1, the tubes 32 and passages 30 are axially aligned to each other at right angles to the axis of body 10.

The injection nozzle assembly 11 mounted in the lower nozzle case portion 16 of body 10 includes, in succession, starting from the upper end, with reference to FIG. 1, a seat element 40, a swirl director plate 44 and a spray tip 50. The seat element 40, in the form of an annular disc, is provided with a central axial discharge passage 41 therethrough of predetermined diameter and with a conical valve seat 42 on its upper surface 43 which is formed concentric with the discharge passage 41. The swirl director plate 44, which is circular disc-like in configuration, is provided with a plurality of circumferentially spaced apart, radially inward inclined and axially downward extending director passages 45 therethrough, described in greater detail hereinafter. The spray tip 50 is provided with a stepped axial discharge passage therethrough providing, in the embodiment shown in FIG. 1, a swirl chamber 51 and a spray orifice discharge passage 52 formed substantially concentric with each other.

Each of the director passages 45 in the director plate 44, only one being shown in FIG. 1, has its upper end positioned to be in fluid communication with the lower end of the discharge passage 41 in the seat element 40 and has its opposite end positioned so as to open into the swirl chamber 51 whereby the fuel flowing through each of these director passages is discharged into the swirl chamber in a direction to flow with an eddying or swirling motion within the swirl chamber 51. This swirling movement imparted to the fuel continues as the fuel flows from the swirl chamber 51 out through the spray orifice discharge passage 52. The fuel thus flows with both a swirling component as well as an axial velocity component into the induction system for the engine, not shown. Thus, both the swirl chamber 51 and the spray orifice discharge passage 52 are properly sized, as desired, and described further hereinafter, so that the fuel is conveyed or discharged from this nozzle assembly with a rotary motion imparted thereto by passage of fuel through the director passages 45 whereby to enhance the atomization of the fuel as it is discharged from the injector. With this arrangement, the subject unit injector can be used to properly atomize fuel delivered to the injector at a low supply pressure, for example, on the order of 10 psi.

The seat element 40, director plate 44 and spray tip 50, in the construction shown in FIG. 1, are stacked face to face and positioned in the lower cavity formed by the cylindrical wall 25 in the nozzle case portion 16 with the outer peripheral edge portion of the upper surface 43 of seat element 40 in abutment against the shoulder 27 and these elements are retained in this position by the inwardly spun over lower end rim **16*a* of nozzle case portion 16. In the construction shown in FIG. 1, the seat element 40 is provided with a cylindrical upper outer wall 40*a* adjacent to surface 43 and with a flat shoulder 40*c*. Both the outer wall 40*a* of the seat element 40 and the outer peripheral edge of the spray tip 50 are suitably sized relative to the internal diameter of the wall 25** whereby this wall provides for axial alignment of these elements.

An O-ring seal 54 is operatively positioned to effect a seal between the seat element 40 and the wall 25. In the construction shown in FIG. 1, the seat element 40 is provided with an external reduced diameter wall **40*b* at its lower end to receive the O-ring seal 54. The ring seal 54 is retained axially in one direction by the flat shoulder 40*c* of the seat element 40 and in the opposite direction by its abutment against the upper surface of director plate 44**.

Flow through the discharge passage 41 in seal element 40 is controlled by the valve 12 which is loosely received within the fuel chamber 23. This valve member is movable vertically between a closed position at which it is seated against the valve seat 42 and an open position at which it is unseated, from the valve seat 42, as described in greater detail hereinafter. The valve 12, in accordance with the invention, is of a truncated ball-like configuration to provide a semi-spherical seating surface for engagement against the valve seat 42. As shown in the embodiment of FIG. 1, the valve 12 is made in the form of a ball which is truncated at one end whereby to provide a flat surface **12*a* on its upper side for a purpose to be described, the lower seating surface portion 12*b* thereof being of semi-spherical configuration whereby to be self-centering when engaging the conical valve seat 42. Valve 12 may be made of any suitable hard material which may be either a magnetic or non-magnetic material. For durability, as used in a particular fuel injection system, the valve 12** is made of SAE 51440 stainless steel and is suitably hardened.

To aid in unseating of the valve 12 from the valve seat 42 and to hold this valve in abutment against the lower end of its associated armature 73 when in its open position during periods of injection, a compression valve spring 55 is positioned on the lower side of the valve so as to be loosely received in the discharge passage 41 of seat element 40. As shown in FIG. 1, the valve spring 55 is positioned to abut at one end, its lower end with reference to FIG. 1, against the upper surface of director plate 44 and to abut at its opposite end against the lower semi-spherical portion of valve 12 opposite the flat surface **12*a*. Normal seating and actuation of the valve 12 is controlled by the solenoid assembly 14** in a manner to be described.

Referring now to the solenoid assembly 14 in the injector of FIG. 1, this solenoid assembly includes a tubular coil bobbin 60 supporting a wound wire coil 61. Bobbin 60 is positioned in the upper solenoid case portion 15 of body 10 between the shoulder 26 of the body and the lower surface of a circular pole piece plate 62 of a pole assembly. The pole piece plate 62 has an outer cylindrical peripheral edge surface that is slidably received in the cavity provided by the annular wall 20 for abutment against the shoulder 21 and it is then axially retained thereagainst by the radially inward spun over upper rim **15*a* of the solenoid case portion 15**.

As shown, coil bobbin 60 is provided with an axially extending bore aperture **60*b* therethrough of an internal diameter to correspond to the inside diameter of the lower intermediate wall 24 to form, in effect, an axial extension thereof. Pole piece plate 62 is also provided with a central axial bore 62*a* therethrough to receive the tubular core 63 of the pole assembly, the core 63 being welded as at 64 to the pole piece plate 62. As shown, the lower flat end of the core 63 extends into the bore aperture 60*b* of the bobbin 60 a predetermined axial extent and the lower flat end thereof is provided with at least one through recessed slot 63*a* formed at right angles to its axis for a purpose to be described. The pole piece plate 62 is further provided with a through, upright arcuate slot 62*b* to receive the vertical extending arcuate stud 60*a* of bobbin 60 through which the pair of terminal leads 66 extend, only one such lead being shown in FIG. 1. The opposite end of each of these leads 66, not shown, being connected, as by solder, to the terminal ends of the windings of coil 61**.

As is well known, the terminal leads 66 are provided so that the coil 61 of the solenoid can be connected by electrical control circuit wires, not shown, to a suitable electronic control circuit that is operative to energize and de-energize the solenoid of the injector 5 as a function of engine operation in a desired manner as known in the art.

Core 63 is provided with an axial through stepped bore **63*c* that is internally threaded as at 63*b* at its upper end whereby to threadingly receive the external threads of a spring adjusting screw 70 having the usual tool-receiving slot 70*a* at its upper end. Adjusting screw 70 at its lower end is provided with an axial blind bore 71 concentric with the exterior of the screw and of a size so as to receive one end of a cylindrical armature guide pin 72. Armature guide pin 72, made preferably of suitable non-magnetic material, is suitably fixed to the adjusting screw 70, as by a press fit thereto, and with a suitable adhesive coated to their mating surfaces. The armature guide pin 72 is of an axial length so that when fixed to the adjusting screw 70, as described, the lower end portion of the armature guide pin will extend a predetermined axial distance downward below the slotted end 63*a* of the armature core 63** for a purpose to be described.

The plunger-like armature 73 of the solenoid assembly is provided with a circular outer peripheral surface of a predetermined dimension whereby this armature 73 is loosely slidably received in the armature guide bore provided by the lower intermediate wall 24 in the solenoid case 15 and also is slidably received within the lower end portion of the guide bore aperture **60*b*. A large clearance is shown between these elements in FIG. 1 for purposes of illustration only, the actual clearance between these elements being described in greater detail hereinafter. The armature 73 is formed with a stepped central bore therethrough to provide an upper spring cavity 74 portion and a lower pin guide bore 75 portion of a preselected diameter in which the armature guide pin 72 is slidably received. The armature 73 at its lower flat end; that is, the flat end thereof which abuts against valve 12, is provided with a central radial extending through slot 76** that is formed at right angles to the axis thereof.

The armature 73 is thus slidably positioned for vertical movement between a lowered position shown in FIG. 1 at which its lower flat end, with slot 76 therein, engages the upper flat surface **12*a* of valve 12 to force the valve into seating engagement with the valve seat, in a manner to be described, and a predetermined raised position. In the construction shown in FIG. 1 the extent of the raised position is established by engagement of the upper end of the armature 73 against the lower slotted end 63*a* of the core 63. During movement of the armature 73 to this raised position, the spring 55 is then operative to effect unseating of the valve 12 and to then maintain this valve in abutment against the lower flat end of armature 73 during opening and closing movement of the valve against the force of fuel flowing through the fuel chamber 23**.

Biasing of the armature 73 to its lowered position and, therefor of the valve 12 to its closed position in seated engagement against the valve seat 42, is effected by means of a coiled return spring 77, of a predetermined force value greater than the force value of the valve spring 55, which is positioned in the spring cavity 74 provided in the armature 73. The spring 77 is positioned to loosely encircle the armature guide pin 72 and is of a diameter whereby one end of the spring 77 is positioned so as to extend into the bore 63*c* of the core to abut against the lower end of the spring adjusting screw 70. At its opposite end, the spring 77 abuts against a radial shoulder 73*a* defining the lower end of the spring cavity 74 in the armature 73. The spring 77, of a preselected force, thus normally operative to bias the armature 73 downward, to the position shown in FIG. 1 so as to effect seating engagement of the semi-spherical seating surface of the valve 12 onto the valve seat 42 against the biasing force of spring 55 when the coil 61 is de-energized.

Both the lower end of the core 63 and the lower end of the armature 73 are slotted, as previously described. These slots are operatively effective so as to eliminate hydraulic locking and fluid pressure differential between respective mating surfaces. Hydrostatic pressure relief occurs since each of the transverse slots provides an escape path for any entrapped liquid fuel between the respective mating surfaces. The liquid fuel will flow from the center radially outward in opposite directions through the slot 63*a*, for example, as the armature 73 moves upward toward the core 63 during cyclic operation of the injector.

With the solenoid coil 61 de-energized and with the armature 73 positioned as shown, an air gap is provided between the upper end of the armature 73 and the lower end of core 63, the air gap being relatively small in axial length, an example of a suitable air gap length being described hereinafter. In the construction illustrated in FIG. 1, the desired axial extent of air gap is obtained by the selective fit of the component elements of the injector.

As shown, the armature 73 is guided for vertical axial movement by means of the small diameter armature guide pin 72 which is suitably, slidably received in the pin guide bore 75 of the armature 73. The clearance between the outside diameter of the armature 73 and the inside diameters of the aperture bore 60*b* of bobbin 60 and wall 24 of body 10 is preselected so as to provide a reasonable clearance. This clearance should be such whereby hydraulic dampening is reduced. In addition, the coupling air gap provided by this clearance should be at a reasonable minimum, while at the same time the clearance should be adequate so as to eliminate any problems which would otherwise be encountered due to minor nonconcentricity of these parts. Thus in accordance with one feature of the subject invention, guiding the armature 73 by means of the small diameter guide pin 72 is operative to reduce the sliding friction of the armature, as compared to an armature guided by its larger outer peripheral surface, thereby providing a means whereby the dynamic response time of the injector is improved.

In the construction illustrated in FIG. 1, the bobbin 60 is provided with annular recessed grooves at opposite ends thereof radially outward of the bore aperture 60*b* to receive O-ring seals 80 and 81. The O-ring seal 80 is used to effect a seal between the shoulder 26 and the lower end of bobbin 60, while the O-ring seal 81 is used to effect a seal between the bobbin 60 and the outer peripheral surface of the core 63.

Figure 3:
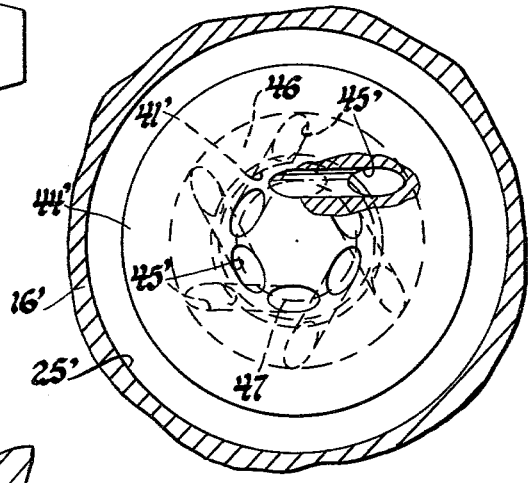
FIG. 3 is a sectional view taken along line 3—3 of FIG. 2 showing the director passages through the swirl director plate of the nozzle assembly of the electromagnetic fuel injector shown in FIG. 2, with a part taken away to show a director passage in detail.
Figure 2:
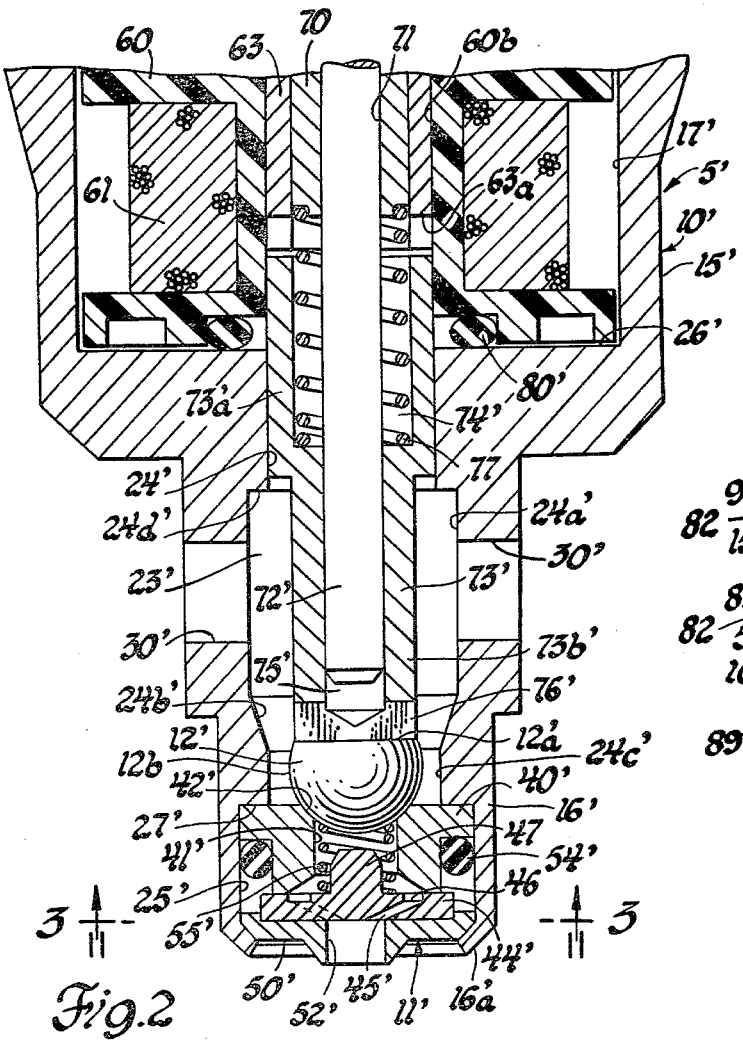
FIG. 2 is an enlarged longitudinal, cross sectional view of a portion of an alternate embodiment electromagnetic fuel injector in accordance with the invention, showing the armature guide pin and valve member thereof in elevation.

An alternate embodiment of the electromagnetic fuel injector, generally designated 5', constructed in accordance with the invention, is shown in FIGS. 2 to 4, wherein similar parts are designated by similar numerals with the addition of a prime (') after the reference numbers. In this alternate embodiment, as best seen in FIG. 2 the body 10' of the injector 5' is of a greater length than the body 10 in the embodiment of FIG. 1, the extra length being added, in effect, between the shoulders 26' and 27' of the lower solenoid case portion 15' portion of the body 10 for use in a particular engine fuel injection system application.

In this alternate embodiment, the cylindrical lower intermediate wall between the shoulders 26' and 27' of the body 10' is of stepped configuration whereby to provide an upper annular wall 24' portion for slidably receiving the upper large diameter end portion 73*a'* of the armature 73' and a cylindrical lower stepped wall portion. This lower stepped wall portion includes a vertical wall 24*a'* that is of a greater diameter over its axial length than the diameter of wall 24', an inward inclined wall 24*b'* connecting wall 24*a'* to a vertical bottom wall 24*c'*. These last mentioned walls form with the reduced diameter lower end portion 73*b'* of armature 73' a fuel chamber 23' of increased capacity as compared to the fuel chamber 23 in the injector 5 of FIG. 1. As shown, a flat shoulder 24*d'* interconnects walls 24' and 24*a'* and walls 24*c'* and 25' are interconnected by the flat shoulder 27'. Also in this embodiment, the port passages 30' open into the fuel chamber 23' slightly above the valve 12' so that, if any fuel vapors are present in the fuel chamber 23', these vapors will tend to rise upward so that only liquid fuel is present adjacent to the metering land defined by the valve 12' and its valve seat 42'.

Referring now to the nozzle assembly 11' used in the alternate embodiment of the injector 5' shown in FIG. 2, this nozzle assembly includes a seat element 40' with its axial discharge passage 41' therethrough, a modified swirl director plate 44' and a modified spray tip 50'. As shown, the swirl director plate 44' is provided with a plurality of circumferentially, equally spaced apart, inclined and axially extending director passages 45', six such passages being shown in FIG. 3. These passages 45' extend from an annular groove 46 provided on the upper face of the swirl director plate 44'. This groove 46 is positioned so as to encircle a boss 47 that is integrally provided on the swirl director plate so as to extend vertically upward from the upper surface of the main body surface of the swirl director plate. This boss 47 is of an external diameter and of an axial extent, as desired, so as to be loosely received in the discharge passage 41' of seat element 40'. Also as shown, in this embodiment, the lower end of the discharge passage 41' is radially outwardly flared a suitable amount whereby to insure free fluid flow from this passage into the groove 46. The upstanding boss 47 serves to center the spring 55' and to appreciably reduce the volume capacity available for fuel in the discharge passage 41'. In this alternate embodiment shown in FIG. 2, the spray tip 50' of this injector is provided with a straight through passage therethrough which serves as a combined swirl chamber-spray orifice passage 52' for the nozzle assembly.

The diameter of this combined swirl chamber-spray orifice passage 52' is preselected, as desired, preferably so as not to form a flow restriction as described in greater detail hereinafter. As best seen in FIG. 3, each of the director passages 45' is inclined and radially positioned, as desired, whereby to provide for substantial downward and tangential entry of fuel into this swirl chamber-spray orifice passage 52' so as to effect both swirling motion and downward flow direction to the fuel, whereby to provide for good atomization of the fuel. Preferably, the lower edge of this passage 52' like the discharge passage 52 terminates in substantially an annular knife edge, as best seen in FIG. 2, so as to reduce the possibility of fuel dripping from the lower edge of the spray orifice discharge passage.

Referring now to FIG. 4, an electromagnetic fuel injector 5', in accordance with the embodiment of FIG. 2, is shown mounted within a socket 82 formed by a vertical stepped bore, for example, in the fuel injector holder portion 84 of an injector mechanism of a throttle body injection apparatus for use on an internal combustion engine.

In the construction shown in FIG. 4, the socket 82 provides a cylindrical upper wall 85, a cylindrical upper intermediate wall 86, a cylindrical lower intermediate wall 87 and a cylindrical lower wall 88. Such walls are of progressively reduced diameters relative to the wall next above. Walls 85 and 86 are interconnected by bevel shoulder 83. Walls 86 and 87 are interconnected by flat wall 89. Walls 87 and 88 are interconnected by flat wall 89*a*. In the construction illustrated, the electromagnetic fuel injector 5' is retained within the socket 82 by means of an apertured retainer plate 91 suitably fixed to the fuel injector holder portion 84. The retainer plate 91 is provided with a vertical aperture 91*a* therethrough to permit access to the leads 66 of the injector 5'.

The electromagnetic fuel injector 5' is positioned in the socket 82 with the enlarged stepped upper portion of the solenoid case portion 15' of the body 10' suitably received within the upper wall 85, bevel shoulder 83 and the upper intermediate wall 86, which are sized and shaped to conform to the adjacent exterior portions of the body 10'. The upper portion of the nozzle case portion 16' of the body 10' is encircled by the lower portion of wall 86 and, the lower end thereof is received within the lower intermediate wall 87 and lower wall 88 as shown in FIG. 4. The reduced diameter lower portion of the body 10'; that is, the portion of the body 10' next adjacent to the valve 12' therein, defines with the lower intermediate wall 87 an annular fuel chamber 92. As seen in FIG. 4, the spray tip 50' of the injector 5' extends outward of the injector holder portion 84 whereby fuel can be discharged therefrom into a suitable induction passage 90 provided beneath the lower wall 84*a* of the injector holder portion 84.

Fuel is supplied from a low pressure fuel source, not shown, to the fuel chamber 92 by means of horizontal fuel inlet passages 93 provided in the injector holder portion 84 to open into one side of the fuel chamber 92. Diametrically opposite this inlet passage 93, in the construction shown, there is provided a fuel return passage 94 that is adapted to be connected to a suitable fuel return conduit, not shown. It will be apparent that these passages 93 and 94 need not be located diametrically opposite each other to provide for the circulation of excess fuel in the fuel chamber 92 whereby to effect cooling of the injector 5' in addition to supplying fuel to fuel chamber 23' thereof. Suitable O-ring seals 95 and 96 are used to effect a suitable seal between the upper portion of the solenoid case portion 15' of this injector and the fuel injector holder portion 84 and between the nozzle case portion 16' and the fuel injector holder, respectively, whereby to seal the fuel chamber 92 at opposite axial ends thereof, as desired.

Figure 5:
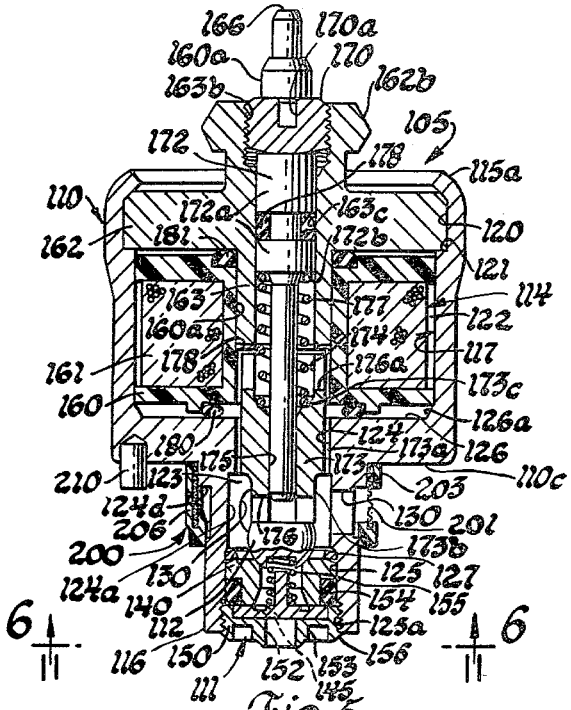
FIG. 5 is a longitudinal cross sectional view of a preferred embodiment of an electromagnetic fuel injector in accordance with the invention taken along line 5—5 of FIG. 6, the armature guide pin and valve member being shown in elevation, but with part of the valve member broken away.
Figure 6:
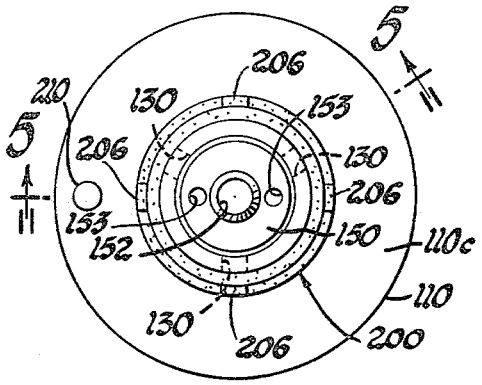
FIG. 6 is a bottom plan view of the injector of FIG. 5 taken along line 6—6 of FIG. 5.
Figure 7:
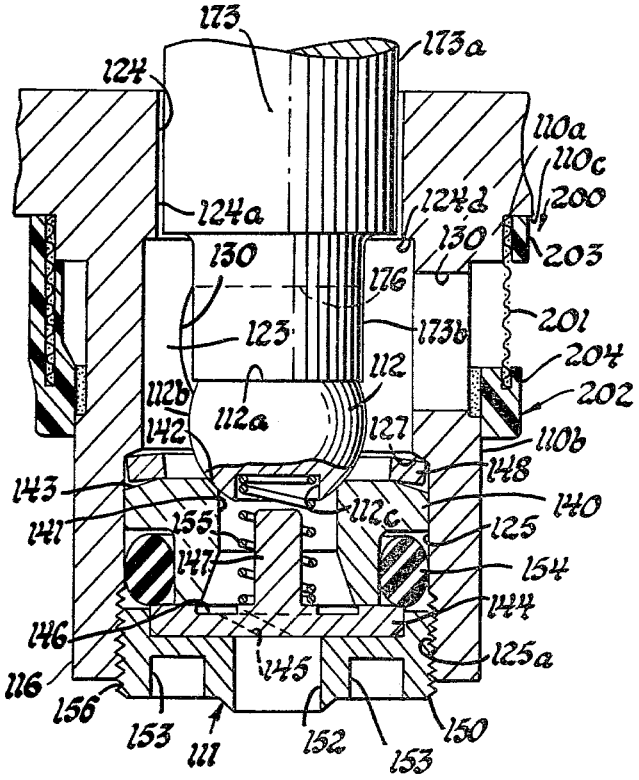
FIG. 7 is an enlarged fragmentary sectional view of the lower portion of the injector of FIG. 5 to show a first embodiment of a calibration abutment washer, the armature of this assembly being shown in elevation.

Referring now in particular to FIGS. 5, 6 and 7, there is illustrated preferred embodiment of the subject electromagnetic fuel injector, generally designated 105, wherein similar parts relative to the previously described injectors are designated by similar numerals but with numerals in the 100 series as will be apparent.

In this preferred embodiment, the cylindrical cavity 117 defined by the stepped bore through the body 110 of this injector 105 provides cylindrical walls 120, 122, 124 and 125 and interconnecting shoulders 121, 126 and 127 corresponding to walls 20, 22, 24 and 25 and shoulders 21, 26 and 27, respectively, of the body 10 in the embodiment of the injector 5 shown in FIG. 1. However, in this preferred embodiment, the cylindrical wall 124 is of stepped diameters whereby to provide an upper portion 124 of a diameter to loosely slidably receive the large diameter portion 173*a*' of the armature 173 and a lower cylindrical wall portion 124*a* of a diameter greater than the diameter of wall portion 125 whereby to form with the reduced diameter lower end portion 173*b* of the armature the annular fuel chamber 123.

In addition, in this preferred embodiment, the lower cylindrical wall 125 is provided at its free end with an internally threaded portion 125*a*. The shoulder 127 interconnecting the walls 124*a* and 125, in a preferred embodiment, as shown in FIGS. 5 and 7, is preferably beveled at a predetermined angle to the axis of the cavity, as best seen in FIG. 7 and is located a predetermined axial distance from the lower flat end of the core 163, to be described, all for a purpose described in detail hereinafter.

As shown in FIGS. 5, 6 and 7, the body 110 of injector 105 adjacent to its lower end is provided, in the construction illustrated, with three circumferentially equally spaced apart radial port passages 130 that extend at right angles to the axis of the body and are located so as to open into the fuel chamber 123. Since this electromagnetic fuel injector 105 is constructed for mounting into a suitable socket, similar to that shown in FIG. 4, provided in the injector holder portion 84 of an injector mechanism, these radial port passages 130 would thus be suitably located so as to be in direct fluid communication with the annular fuel chamber 92 that would be thus defined by the outer peripheral surface of the body 110 of the injector and one or more of the adjacent cylindrical walls defining portions of the socket receiving the injector 105 within the injector holder portion 84 of an injector mechanism.

Figure 9:
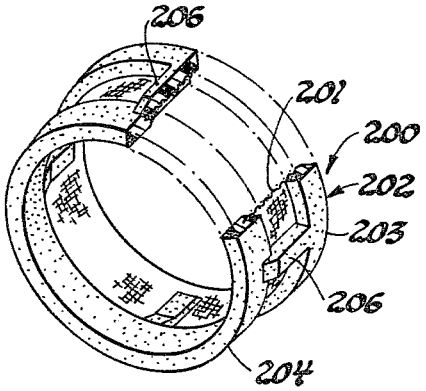
FIG. 9 is a perspective view of the fuel filter assembly, per se, shown assembled to the fuel injector in FIGS. 5 to 8.

To effect filtering of the fuel being supplied to the injector 105 prior to its entry into the fuel chamber 123, there is provided a fuel filter assembly, generally designated 200 as shown in FIG. 9. The fuel filter assembly 200 is adapted to be suitably secured, as for example by a pedetermined press fit, to the body 110 in position to encircle the radial port passages 130 therethrough.

In the construction shown, the filter assembly 200 includes an annular upright filter screen 201 supported in a ring-like frame 202. The frame 202, which may be molded for example of a suitable glass fiber filled plastic material, includes in the construction shown, spaced apart upper and lower rings 203 and 204, respectively, with reference to FIGS. 6 and 7 that are secured together in spaced apart relation to each other by vertical support members 206 formed integral therewith. Four such support members 206 are used in the embodiment of the filter assembly illustrated, as best seen in FIG. 9.

As shown, the upper and lower edge portions of the filter screen 201 are embedded in portions of the upper and lower rings 203 and 204, respectively, and in the support members 206 of the filter frame 202. The frame 202 structure with the filter screen thus attached thereto is such so as to, in effect, provide four circumferentially spaced apart windows or openings through the frame 202 that are covered solely by the material of the filter screen 201. In a particular construction, the filter screen 201 per se, is formed so as to provide 40 micron mesh openings therethrough, with the filter screen 201 being woven with screen thread of 30 micron diameter.

As shown, the upper support ring 203 with the upper edge of the filter screen 201 attached thereto and the lower support ring 204 of the filter frame 202 are each of a predetermined selected internal diameter whereby they can be press fitted over the cylindrical outer diameter portions 110*a* and 110*b*, respectively, of the body 110. The upper ring 203 is positioned so as to abut against the radial flange 110*c* of the injector body 110.

By providing the filter frame 202 with four openings and the body 110 with three port passages 130, it will be now apparent that no means need be provided to rotatively align the filter frame on the body with respect to the port passages 130, since with any random orientation of the filter assembly 200 on this body 110, no more than one port passage 130 can be completely blocked by a vertical support member 206 of the filter frame 202, as best seen in FIG. 6.

In the construction shown in FIG. 5, the radial shoulder 110*c* of the body 110 is provided with a suitable aperture to receive an alignment pin 210 whereby a portion thereof will extend axially downward from this shoulder. This alignment pin 210 is adapted to be received in a complementary shaped aperture which would be provided in a suitable shoulder, not shown, of a socket 82 for example, in the injector holder portion 84 of an injector mechanism similar to that shown in FIG. 4, so as to effect rotational alignment of the injector therein. Thus electrical circuit wires in an electrical circuit connector of an electrical harness assembly, all not shown, can be operatively connected to the terminal leads 166 of the injector 105 in a fixed position relative to the injector holder portion 84.

The injector nozzle assembly 111 mounted in the nozzle case portion 116 of body 110, in the construction shown in FIGS. 5, 6 and 7, includes in succession starting from the upper end with reference to FIGS. 5 and 7, a seat element 140, a swirl director plate 144 and a spray tip 150. In this preferred embodiment, the seal element 140 is provided with a central axial discharge passage 141 therethrough, this passage being tapered outward at its lower end whereby its outlet end diameter is substantially equal to the outside diameter of the annular groove 146 provided in the upper surface of the swirl director plate 144. The seat element 140 is also provided with a conical valve seat 142 on its upper surface 143, the valve seat being formed concentric with and encircling the upper end of the discharge passage 141. The upper surface 143 of the seat element 140, in the embodiment shown in FIGS. 5 and 7, is downwardly tapered adjacent to its outer peripheral edge. This tapered surface is formed at an angle of, for example, 10° to 11° from the horizontal so as to provide an abutment shoulder for the outer peripheral annular edge on one side of an abutment washer 148 for a purpose to be described.

The swirl director plate 144, which is similar in construction to the swirl director plate 44' shown in FIGS. 2 and 3, is provided with a plurality of circumferentially, equally spaced apart, inclined and axially extending director passages 145. Preferably, six such passages are used, although only one such passage is shown in FIGS. 5 and 7. These director passages 145, of predetermined equal diameters, extend at one end downward from an annular groove 146 provided on the upper surface of the swirl director plate 144. The groove 146, as shown, is positioned so as to encircle a boss 147 formed integral with the director plate to extend vertically upward from the upper surface of the main body portion thereof. The boss 147 thus extends vertically upward loosely into the discharge passage 141 so as to terminate at a predetermined location, a location that is axially spaced from the lower end of the valve element 112 when it is in its seated position shown.

The spray tip 150 is provided with a straight through passage 152 which serves as a combined swirl chamber-spray orifice passage for the discharge of fuel from this nozzle assembly. As shown the spray tip 150 is provided at its upper end with a recessed circular groove of a size so as to receive the main body portion of the swirl director plate 144 therein whereby to locate this element substantially coaxial with the axis of the swirl chamber-spray orifice passage 152.

In accordance with another feature of the invention, the outer peripheral surface of the spray tip 150 is provided with external threads 156 for mating engagement with the internal threads 125*a* provided in the lower end of the body 110. Preferably the threads 125*a* and 156 are of suitable fine pitch whereby to limit axial movement of the spray tip, as desired, for each full revolution of the spray tip relative to body 110 as desired. The lower face of the spray tip 150 is provided, for example, with at least a pair of diametrically opposed blind bores 153 of a size so as to slidably receive the lugs of a spanner wrench, not shown, whereby rotational torque may be applied to the spray tip 150 during assembly and axial adjustment of this element in the body 110.

With reference to the fuel injectors 5 and 5' shown in FIGS. 1 and 2, respectively, in these injectors dimensional control of the injector stroke would normally be accomplished by use of a selective fit approach during injector assembly of the core, ball and seat components thereof as is conventional in the injector art. Preferably the stroke control in a particular construction would be on the order of plus or minus 0.0002 in. with, for example, a 0.0048 in. nominal stroke for such an injector.

Now in accordance with this feature of the invention, as shown in the preferred embodiment injector 105, the injector stroke can be accurately adjusted by the use of a collapsible abutment member between the upper surface of the valve seat element 140 and the shoulder 127 of the body 110. The collapsible abutment member, in the construction of the embodiment shown in FIGS. 5 and 7, is in the form of a flat spring abutment washer 148 of a suitable outside diameter to be slidably received within the lower wall 125 so as to abut against shoulder 127 located a predetermined axial distance from the lower flat end of core 163. The washer 148 when first installed would be flat. As thus assembled, the upper outer peripheral edge of the washer 148 would engage against the outer radial portion of the shoulder 127 and its radial inner edge on the opposite side of the washer would abut against the upper tapered surface 143 of the seat element 140. With the washer 148, seat element 140, swirl director plate 144, and the spray tip 150 thus assembled with the spray tip 150 in threaded engagement with internal threads 125*a*, these elements can then be axially adjustably positioned upward within the lower end of the body 110.

After these elements are thus assembled, in actual use during calibration of the injector, adjustment of the injector stroke is made while the injector is flowing calibration fluid on a continuous basis. During flow of the calibration fluid, an operator, through the use of a spanner wrench, not shown, can rotate the spray tip 150 in a direction whereby to effect axial displacement thereof in an upward direction with reference to FIGS. 5 and 7. As the nozzle assembly is moved axially upward by rotation of the spray tip 150, the seat element 140 thus moved would cause the spring washer 148 to deflect or bend into a truncated cone shape, the position shown in FIGS. 5 and 7, to thereby in effect forceably move the lower abutment surface of the washer 148 upward relative to the fixed shoulder 127 until the desired flow rate is achieved to thereby axially position the valve seat 142 of the seat element 140 to thus establish the proper stroke length of the armature/valve for that injector. The spray tip 150 is then secured against rotation relative to the body 110 by any suitable means such as, for example, by laser beam welding at the threaded inner face of these elements.

Figure 8:
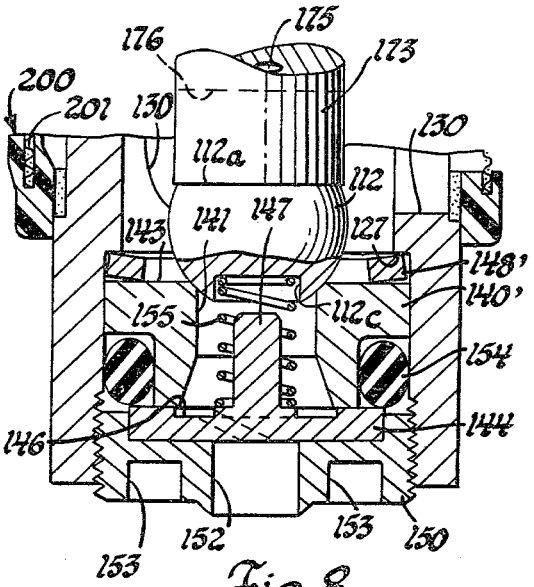
FIG. 8 is an enlarged fragmentary sectional view similar to FIG. 7 but showing an alternate form of a calibration abutment washer.

In the alternate embodiment of the injector stroke adjusting means shown in FIG. 8, both the shoulder 127 and the upper surface 143 of the seat element 140' are formed as substantially flat surfaces. In this alternate embodiment, the spring abutment washer 148' is in the form of a Belleville washer that is, a washer which, in its original configuration, is of truncated cone shape. The abutment washer is positioned so that the outer peripheral upper edge of the base thereof abuts against the shoulder 127 while the lower inner perihperal edge at the inner conical tip end of the abutment washer 148' abuts against the upper surface 143 of the seat element 140'. After thus being assembled, during calibration, the stroke would then be adjusted by rotation of the spray tip 150 in a direction whereby to effect flexing of this Belleville spring washer 148' in a direction, upward as shown, whereby to effect some flattening thereof, as compared to its original cone shape, until the desired flow rate is obtained, thereby setting the desired injector stroke length for this injector. As previously described, after the stroke has been thus adjusted, as desired, spray tip 150 is then fixed against rotation relative to the body 110, as by welding at the interface of these elements.

Thus each of the abutment washers 148, 148' act as a resiliently axially flexible or movable abutment shoulder in the body 110 against which the upper end of the nozzle assembly 111 abuts to fix its axial position in one direction within the body 110 to thus axially locate the valve seat 142 relative to the lower end of the core 163.

With the above described arrangement, the effective flow orifice of the valve and valve seat interface as generated by injector stroke is controlled directly within vary close tolerances by an actual flow measurement rather than by a mechanical displacement gauge measurement and this is accomplished after assembly of the injector. Also, with this arrangement, the necessity of gauging and of selective fitting of various components is eliminated. In addition, less injector rework after assembly would be required since means are provided to vary the stroke as desired.

In the embodiment of the valve 112 shown in FIGS. 5–7 and 8, the valve 112 is similar to the valve 12 previously described except that a spring guide means for the valve spring 155 is provided at the lower end of this valve. In the construction shown, the valve 112 at its end opposite the flat 112*a* is provided with a recessed aperture 112*c* of circular configuration whereby to receive one abutting end of the valve spring 155. The opposite end of this spring 155 abuts against the upper surface of the swirl director plate 144 and is positioned so as to encircile the boss 147 thereon. Although the spring guide, in the preferred embodiment, is shown as formed by a recessed aperture 112*c* in the lower end of the valve 112, it will be readily apparent to those skilled in the art that this spring guide could take the form of a circular guide pin, not shown, either depending downward from the lower end of the valve 112 or formed thereon as by grinding material, as necessary from the lower end of the valve.

The solenoid assembly 114 of the injector 105 includes a tubular bobbin 160 supporting a wound wire coil 161. Bobbin 160 is positioned in the body 110 between the shoulder 126 thereof and the lower surface of a circular pole piece 162 that is slidably received at its outer peripheral edge within the wall 120. Pole piece 162 is axially retained within body 110 as by being sandwiched between the shoulder 121 and the radially inward spun over upper rim 115*a* of the body. Seals 180 and 181 are used to effect a seal between the shoulder 126 and the lower end of bobbin 160 and between the upper end of bobbin 160 and the lower surface pole piece 162, as seen in FIG. 5.

Formed integral with the pole piece 162 and extending centrally downward therefrom is a tubular core 163. Core 163 is of a suitable external diameter so as to be slidably received in the bore aperture 160*a* that extends coaxially through the bobbin 160. The core 163, as formed integral with the pole piece 162, is of a predetermined axial extent so as to extend a predetermined axial distance into the bobbin 160 in axial spaced apart relation to the shoulder 127. The pole piece 162, in the construction illustrated, is also provided with an upstanding central boss 162*b* that is radially enlarged at its upper end for a purpose which will become apparent.

Pole piece 162 and its integral core 163 are formed with a central through stepped bore 163*c*. The cylindrical annular wall, defined by the bore 163 is provided at its upper end within the enlarged portion of boss 162*b*, with internal thread 163*b*. A spring adjusting screw 170, having a tool receiving slot 170*a*, for example, at its upper end, is adjustably threadingly received by the thread 163*b*.

Pole piece 162 is also provided with a pair of diametrically opposed circular through slots, not shown, that are located radially outward of boss 162*b* so as to receive the upright circular studs 160*a* of bobbin 160, only one such stud 160*a* being shown in FIG. 5. Each such stud 160*a* has one end of a terminal lead 166 extending axially therethrough, the opposite end, not shown, of each such lead being connected, as by solder, to a terminal end of coil 161. The terminal end, not shown, of coil 161, the studs 160*a*, and of the through slots, not shown, in the pole piece 162 are located diametrically opposite each other whereby to enhance the formation of a more uniform and symmetrical magnetic field upon energization of the coil 161 to effect movement of the cylindrical armature 173 upward without any significant side force thereon to thereby eliminate tilting of the armature. Such tilting would tend to increase the sliding friction of the armature 173 on its armature guide pin 172.

The cylindrical armature guide pin 172, FIG. 5, made of suitable non-magnetic material, is provided with axially spaced apart enlarged diameter upper end portions whereby to define axially spaced apart cylindrical lands 172*a* that are of a diameter whereby they are guidingly received in bore 163*c* of the core 163 so as to effect coaxial alignment of the armature guide pin 172 within this bore and thus within the body 110. The enlarged upper end of the armature guide pin 172 is positioned to abut against the lower surface of the spring adjusting screw 170 while the reduced diameter opposite end of the armature guide pin 172 extends axially downward from the core 163, a suitable distance to serve as a guide for aligned axial movement of the armature 173 thereon. A suitable seal, such as an O-ring seal 178, is sealingly engaged against a wall portion of the core 163 defining bore 163*c* and a reduced diameter portion of the armature guide pin 172 between the lands 172*a*.

The armature 173 of the solenoid assembly 114 is of a cylindrical tubular construction with an upper portion of an outside diameter whereby this armature is loosely slidably received within the lower intermediate wall 124 of the body and in the lower guide portion of the bore aperture 160*a* of bobbin 160. The armature 73 is formed with a stepped central bore therethrough to provide an upper spring cavity 174 portion and a lower pin guide bore 175 portion of a preselected inside diameter whereby to slidably receive the small diameter end portion of the armature guide pin 172. As previously described, the armature is guided for its axial movement by the armature guide pin 172. The armature 173 at its lower end is provided with a central radial extending through narrow slot 176 formed at right angles to the axis of the armature. At its opposite or upper end, the armature 173 is also provided with at least one right angle, through narrow slot 176*a*.

A shim 178 of washer-like configuration made of suitable non-magnetic material and of a predetermined thickness is positioned axially between the lower end of the core 163 and the upper end of the armature 173, as by having this shim abutting against the lower surface of the core 163 for a purpose to be described next hereinafter.

With this arrangement, the armature 173 is thus slidably positioned for vertical axial movement between a lowered position, shown in FIGS. 5 and 7 at which it abuts against the upper flat surface 112*a* of valve 112 to force the valve into seating engagement with the valve seat 142 and a raised position at which the upper end of the armature 173 abuts against the lower end of the core 163 with the shim 178 sandwiched therebetween. When the armature 173 is in its lowered position, an air gap is established between the lower end of the core 163 and the upper end of the armature 173. This air gap can be preselected as desired.

In a particular construction of the injector 105 for use in a specific fuel injection system, the air gap or axial extent between the lower flat end of the core 163 and the upper flat end of the armature 173, when the latter is in its lowered position shown, was approximately 0.006 inch. In this construction, the shim 78 was 0.002 inch thick. Thus, although the air gap was approximately 0.006 inch in axial length, with the shim 178 positioned in this air gap, the actual axial extent of movement of the armature upon energization of the solenoid was approximately 0.004 inch.

Armature 173 is normally biased to its lowered position with the valve 112 seated against the valve seat 142 by means of a coil return spring 177 of a predetermined force value greater than that of the valve spring 155. Spring 177 is positioned in the spring cavity 174 and in the bore of core 163. The spring 177 is thus positioned to encircle the lower reduced diameter end of the guide pin 172 with one end of the spring positioned to abut against a radial shoulder 173*c* at the bottom of the spring cavity 174 and, at its opposite end, the spring 177 abuts against a radial shoulder 172*b* of the armature guide pin 172 whereby to bias this pin into abutment against the spring adjusting screw 170.

As an example, in a particular construction, the force of the return spring 177, as installed, was substantially 7.8 N (newtons) while the nominal force for the valve spring 155 was 2.78 N. These forces are substantially the same in both the valve-open and valve-closed conditions.

Applicant has discovered that improved dynamic or "pulse-to-pulse" flow repeatably of an electromagnetic fuel injector is obtained if a ball-like valve flow-control member thereof is centered at initial assembly and then remains essentially centered during subsequent injector operation. If this does not occur, the ball-type valve has a tendency to bounce side-to-side as it positions itself relative to the associated valve seat at each injector closure.

To avoid this condition, in accordance with one aspect of the invention, a truncated ball-type valve element is used. This valve 112, with reference to the preferred embodiment (FIGS. 5, 7) is assembled in the injector 105 whereby the truncated or flat face 112*a* portion thereof lays against the flat end of the armature 173 of the solenoid assembly 114 for the injector. Since the seating surface 112*b* of the valve 112 is of semi-spherical configuration, it is then essentially held in its proper centered position by the following:

The armature 173 is made of magnetic material and, in the preferred embodiment, the valve 112 is also made of magnetic material, for example, a suitable stainless steel. In one construction, the armature 173 was made of SAE 1002 steel carbonitrited. Both these elements are somewhat magnetically hard because of heat treatment, the armature 173 because of case hardening, and the valve 112 because it is a through hardened material. Both being magnetically hard, a level of residual magnetism is retained in these elements after de-energization of the coil 161. The valve 112 and armature 173 thus become magnetically attracted to each other at their mating interface even when the coil 161 of the injector 105 is not energized. A central position of the ball is hence maintained once the valve 112 has been centered with respect to the valve seat 142.

The spring 155 maintains an axial force bias which holds the valve 112 in contact with the armature 173 at all times, thus causing the valve 112 to remain radially fixed once it is initially centered by engagement against the valve seat 142 of the valve element 140.

The flat upper surface 112*a* of the valve 112 and the lower flat surface of the armature 173 tend to stick together by hydraulic adhesion (surface tension force) because of the thin fluid film that would be present at all times at their interface during operation of the injector. The extent of this adhesion which may be referred to as hydraulic stiction will, of course, depend on the presence of a fluid film at the interface and the geometry of contact between the flat surface 112a of the valve 112 and the lower flat end of the armature 173.

It has been found that not all of the above described conditions are necessary to assure that the valve 112 remains centered on the armature 173 relative to the valve seat 142 after the initial centered position is generated by engagement of the valve with the valve seat. Thus, for example, injectors have been run successfully with no evidence of valve bounce and with a non-magnetic valve 112 made, for example, of ceramic material. Also, injectors have been operating successfully without the aid of the spring 155 during pulsed or dynamic operation of the injector for test purposes only. During continuous or static operation of the injector, it is also desirable to use the spring 155 for maintaining the valve 112 open during continued energization of the solenoid assembly 114 of the injector 105 since otherwise, the force of fuel continuously flowing through the fuel chamber 123 out through the discharge passage 141 can create a force unbalance on the valve 112, especially if it is of non-magnetic material, causing it to separate from the armature 173 and move to its closed position even though the solenoid assembly remains energized. The spring 155 is thus operative to maintain the valve 112 in its raised and centered open position during continuous flow of fuel until such time as the solenoid assembly 114 is de-energized at which time the bias of spring 177 would be operative to effect closing movement of valve 112 to its closed position against the valve seat 142.

It has been found that even if the supply of fuel to an injector 105 has been shut off so that the injector then begins to operate without liquid fuel, that is, to operate dry, the thin liquid film at the interface of the flat surface 112a of the valve and the lower flat surface of the armature 173 will remain for an extended period of time whereby the valve 112 continues to be centered on the armature 173 relative to the valve seat 142 by hydraulic stiction.

In accordance with the invention, the valve 112 and the armature 173 are made as separate parts and these components are not structurally fixed together to form a unit armature valve assembly in a manner conventional in prior art electromagnetic fuel injectors. Instead with the valve 112 formed as a separate part, as disclosed, it is free to have its flat surface 112a slide on the lower flat end of the armature at right angles to the axis of the armature whereby to center itself with respect to the valve seat 142 upon forced engagement therewith. For this purpose, the force of the spring 155 should be sufficient so as to maintain contact between the flat 112a of the valve and the lower flat end of the armature 173 during axial movement of these components whereby to maintain a centered position of the valve relative to the valve seat once this centered position is established.

Thus by way of an example, in a particular construction, the force of the valve spring 155 was 2.78N and the force of the return spring 177 was 7.8N. In this particular injector a nominal 7/32 inch diameter valve 112 was used whereby with a nominal 7.8N force for the return spring 177 and a nominal 2.78N force for the valve spring 155, these spring loads resulted in a net installed force level of 5.02N holding the valve 112 against the valve seat 142. With this 7/32 inch diameter valve 112 having a flat of a diameter corresponding to the armature lower end flat face diameter, as shown, the resulting unit loading of the flat 112a against the lower end of the armature 173 was 184.44 kPa (26.75 psi) when the armature 173 is in its raised position and, when the armature is in its lowered position, as shown, the resulting unit loading was 516.435 kPa (74.9 psi). If as described, the diameter of the flat of the 7/32 inch diameter valve is essentially the same as the corresponding lower armature face diameter and then a larger diameter valve, such as a 9/32 inch nominal diameter valve, is substituted for the 7/32 inch valve, its flat would overhang the lower face of the armature and thus would experience the same unit loading as described above.

With respect to valve centering upon contact with the valve seat 142, the 516.435 kPa (74.9 psi) until loading is obviously much lower than the force generated by a point contact at the valve and valve seat interface if the valve was not correctly centered relative thereto. The radial force thus generated tending to center the valve within the valve seat 142 would be much greater than the radial friction force between the flat 112a and the lower flat end of the armature 173, thus effecting centering motion to the valve 112.

The above force values are preferred for injector durability and flow repeatability reasons. Although net spring loads greater than those described above can be used, they are less desirable since if the net spring loads become too great, cavitation erosion can result at the interface of the armature 173 with the core 63 or with the shim 178 sandwiched therebetween.

With the fuel injector structure shown, using the injector of FIGS. 5–7, as an example, the flow discharge restriction in the nozzle assembly thereof can be incorporated into the spray tip/director orifices whereby these elements function as a flow restrictor, that is, as the main restriction to fuel flow through the nozzle assembly when the valve 112 is in the open position. With this arrangement, an increase of armature/valve stroke (to a limiting degree) would not have a marked effect on flow. However, when a number of injectors with this type flow restriction are used in a fuel injection system and are to be fed from a common fuel supply, injectors having spray tip/director orifices of comparable ratings would have to be chosen for the system to ensure substantial equal fuel discharge from each of the injectors.

In the construction shown the main restriction to fuel flow through the nozzle assembly is effected by the valve/valve seat orifice. However, increasing the valve 112 and the valve seat 142 size by increasing the respective diameters thereof, the sensitivity of the injector to changes in the actual stroke length of the armature and therefore of the valve movement is reduced, assuming compensating changes are made in the size of the spray tip/director orifices.

Because of this reduced sensitivity when using a larger diameter valve 112, for example a 9/32 inch nominal diameter ball-like valve as compared to 7/32 inch nominal diameter ball-like valve, the stroke of the larger size valve can be adjusted easier, in the manner described herein, than the stroke adjustment for the smaller size valve to obtain the desired flow characteristics. Also, any increase in stroke of the armature/valve combination due to wear during extended operation of the injector would have a reduced effect on flow (calibration). In addition, by the use of a larger diameter valve/valve seat combination, the larger flow area is operative to provide an improved hollow cone spray due to a smaller pressure drop thereacross as compared to a valve/valve seat combination of reduced flow area, since the increased flow area thus leaves a greater pressure differential after fluid flow therethrough for forcing fuel out through the discharge-director passages. For example, in a particular construction and with fuel supplied at a pressure of approximately 10 psi for discharge to the atmosphere, during static flow conditions this pressure differential was 6.68 psi for the 9/32 inch diameter valve as compared to 4.56 psi for the 7/32 inch diameter valve.

Injectors with the ratio of the valve/valve seat orifice to spray tip/director orifices flow areas in the range of 0.56:1 to 0.95:1 have been tested with satisfactory results but, preferably this ratio of flow areas is in the order of 0.8:1 or higher whereby to reduce the pressure drop across the valve/valve seat flow orifice.

As is apparent, the spray tip/director orifices, in the construction shown with reference to FIGS. 5 and 7, includes the discharge passage 141, director passages 145 and spray discharge orifice passage 152. In this construction, the combined cross-sectional flow area of the director passages 145 is smaller than that of either of the other passages, with the cross-sectional flow area of the spray discharge orifice passage 152 being the largest since this passage also serves as a swirl chamber, as previously described.

What I claim as new and desire to secure by Letters Patent of the United States is:

1. An electromagnetic fuel injector including a housing means providing a fuel chamber therein intermediate its ends adapted to receive fuel and a passage from said chamber through which fuel is injected to an engine, the passage defining an annular valve seat where it communicates with the chamber; a two-part valve means positioned in said fuel chamber for vertical movement relative to said valve seat to open and close the passage; one part of said valve means being a sphere having a flat on one side thereof and being spherical opposite said flat to form a spherical seating surface for valve-closing engagement with said valve seat; the other part being an armature with a flat end face seating against the flat surface of the sphere in a laterally slidable engagement; a valve-closing spring positioned to act on said armature in a direction moving said armature to effect movement of said valve means to its closed position with the sphere part in seating engagement with said valve seat and, a valve-opening spring disposed in said passage and bearing against the sphere in a valve-opening direction to bias said valve means in an opening direction relative to said valve seat and to maintain said flat in abutment against said flat end face in centered position thereon relative to said valve seat during continued opening and closing movement of said valve means relative to said valve seat.

2. An electromagnetic fuel injector including a housing means providing a fuel chamber therein intermediate its ends adapted to receive fuel and a passage from said chamber through which fuel is injected to an engine, the passage defining an annular valve seat where it communicates with the chamber; a two-part valve means positioned in said fuel chamber for vertical movement relative to said valve seat to open and close the passage; one part of said valve means being a sphere of a material capable of retaining a magnetic force, said sphere having a flat on one side thereof and being spherical opposite said flat to define a spherical seating surface for valve-closing engagement with said valve seat; the other part of said valve means being an axial movable armature with a flat end face seating against the flat surface of the sphere in a laterally slidable engagement; a valve-closing spring positioned to act on said armature in a direction moving said armature to effect movement of said valve means to its closed position with the sphere part in seating engagement with said valve seat and, a valve-opening spring disposed in said passage and bearing against the sphere in a valve-opening direction whereby to bias said sphere in an opening direction relative to said valve seat and to continually bias said flat of said sphere against said flat end face of said armature.

3. An electromagnetic fuel injector including a housing means providing a fuel chamber therein intermediate its ends adapted to receive fuel and a passage from said chamber through which fuel is injected to an engine, the passage having an axis and defining an annular valve seat where it communicates with the chamber; a fuel injection nozzle disposed in axially adjustable position at the end of the passage communicating with the engine; a two-part valve means positioned in said fuel chamber for vertical movement relative to said valve seat and generally in the direction of said axis to open and close the passage; on part of said valve means being a sphere having a flat on one side thereof and being sperical opposite said flat to form a spherical seating surface for valve-closing engagement with said valve seat; the other part being an armature with a flat end face seating against the flat surface of the sphere in a laterally slidable engagement in relation to said axis; a valve-closing spring positioned to act on said armature in a direction moving said armature to effect movement of said valve means to its closed position with the sphere part in seating engagement with said valve seat and, a valve-opening spring disposed in said passage and bearing against the sphere in a valve-opening direction to bias said valve means in an opening direction relative to said valve seat and to maintain said flat in abutment against said flat end face in centered position thereon relative to said valve seat during continued opening and closing movement of said valve means relative to said valve seat, said fuel injection nozzle being subject to tilt when adjusted, which tilt is accommodated by lateral slide of said one part of the valve means so as to maintain simultaneous seating against the valve seat.

4. An electromagnetic fuel injector including a housing means providing a fuel chamber therein intermediate its ends adapted to receive fuel and a passage from said chamber through which fuel is injected to an engine, the passage defining an annuar valve seat where it communicates with the chamber; a two-part valve means positioned in said fuel chamber for vertical movement relative to said valve seat to open and close the passage; one part of said valve means being a sphere having a flat on one side thereof and being spherical opposite said flat to form a spherical seating surface for valve-closing engagement with said valve seat; the other part being an armature with a flat end face seating against the flat surface of the sphere in a laterally slidable engagement; a valve-closing spring positioned to act on said armature in a direction moving said armature to effect movement of said valve means to its closed position with the sphere part in seating engagement with said valve seat and, a valve-opening spring disposed in said passage and bearing against the sphere in a valve-opening direction to bias said vave means in an opening direction relative to said valve seat and to maintain said flat in abutment against said flat end face in centered position thereon relative to said valve seat during continued opening and closing movement of said valve means relative to said valve seat, the valve-opening spring force with the valve seated being substantially less than the valve-closing spring force with the valve seated, and the net force at the seating faces being of the order of 500 kPa.

5. An electromagnetic fuel injector including a housing means providing a fuel chamber therein intermediate its ends adapted to receive fuel and a passage from said chamber through which fuel is injected to an engine, the passage defining an annular valve seat where it communicates with the chamber; a fuel injection nozzle threadedly secured to the passage at the end communicating with the engine; a resiliently axially flexible member seated against the passage on one side and the nozzle on the other side to maintain thread pressure while permitting axial adjustment of the nozzle; a two-part valve means positioned in said fuel chamber for vertical movement relative to said valve seat to open and close the passage; one part of said valve means being a sphere having a flat on one side thereof and being spherical opposite said flat to form a spherical seating surface for valve-closing engagement with said valve seat; the other part being an armature with a flat end face seating against the flat surface of the sphere in a laterally slidable engagement in relation to said axis; a valve-closing spring positioned to act on said armature in a direction moving said armature to effect movement of said valve means to its closed position with the sphere part in seating engagement with said valve seat and, a valve-opening spring disposed in said passage and bearing against the sphere in a valve-opening direction to bias said valve means in an opening direction relative to said valve seat and to maintain said flat in abutment against said flat end face in centered position thereon relative to said valve seat during continued opening and closing movement of said valve means relative to said valve seat, said fuel injection nozzle being subject to tilt when adjusted, which tilt is accommodated by lateral slide of said one part of the valve means so as to maintain simultaneous seating against the valve seat.

6. A fuel injector including an injector body having an axial stepped cylindrical bore wall extending therethrough providing a fuel chamber therein intermediate its ends adapted to receive fuel, said wall having internal threads at one end thereof with a radial abutment shoulder axially spaced from said one end; an injection nozzle means positioned in said one end of said injector body, said injection nozzle means defining a discharge passage having a discharge orifice at one end, the opposite end of said discharge passage being in flow communication with said fuel chamber and defining an annular valve seat, said injection nozzle means including externally threaded means in threaded engagement with said internal threads; an electromagnetically actuated valve means positioned in said injector body, said electromagnetically actuated valve means including a solenoid core fixed to said injector body and a two-part valve means positioned for axial movement relative to said valve seat to open and close said discharge passage; one part of said valve means being a sphere having a flat on one side thereof and being spherical opposite said flat to form a spherical seating surface for valve-closing engagement with said valve seat; the other part being an axially movable armature with a flat end face seating against the flat surface of said sphere in laterally slidable engagement therewith, a valve-closing spring positioned to act on said armature to move said armature to said first position; a valve-opening spring disposed in said discharge passage and bearing against said sphere in a valve-opening direction; and a resiliently axially flexible abutment washer sandwiched between said abutment shoulder and said injection nozzle means whereby the axial extent of travel of said armature between said first position and said second position can be varied by axial threaded adjustment of said externally threaded means of said injection nozzle means in said injection body.

7. A fuel injector including an injector body having an axial stepped cylindrical bore wall extending therethrough providing a fuel chamber therein intermediate its ends adapted to receive fuel, said wall having internal threads at one end thereof with a radial abutment shoulder axially spaced from said one end; an injection nozzle means positioned in said one end of said injector body, said injection nozzle means defining a discharge passage having a discharge orifice at one end, the opposite end of said discharge passage being positioned in flow communication with said fuel chamber and defining an annular valve seat, said injection nozzle means including externally threaded means in threaded engagement with said internal threads; an electromagnetically actuated valve means positioned in said injector body, said electromagnetically actuated valve means including a movable valve having a flat on one end thereof and a semi-spherical seating surface for engagement with said valve seat, a solenoid core fixed to said injector body and an armature having a flat surface at one end abutting against said flat of said valve, said armature being movable between a first position at which said armature holds said valve in a position to block flow through said discharge passage with said armature axially spaced apart from said solenoid core and a second position at which said armature is moved so as to operatively abut against said solenoid core to permit unseating of said valve relative to said discharge passage, and a resiliently axially flexible abutment washer sandwiched between said abutment shoulder and said injection nozzle means with one edge of said abutment washer abutting against said abutment shoulder and its opposite edge abutting against said injection nozzle means whereby the axial extent of travel of said armature between said first position and said second position can be varied by axial adjustable threaded adjustment of said externally threaded means of said injection nozzle means in said injection body to effect axial movement of said one edge relative to said opposite edge of said abutment washer.

8. An electromagnetic fuel injector including a hollow tubular body with a stepped bore therethrough providing a fuel chamber therein intermediate its ends adapted to receive fuel; a fuel injection nozzle positioned in said stepped bore at one end of said body to define a spray tip at said one end and an annular valve seat encircling a discharge passage upstream of said spray tip in communication with said fuel chamber; a valve loosely positioned in said stepped bore for movement into and out of engagement with said valve seat; said valve being flat on one side thereof and being spherical opposite said flat to form a spherical seating surface for valve closing engagement with said valve seat; a solenoid means fixed in said stepped bore at the opposite end of said body, said solenoid means having a central aperture therethrough, said central aperture being aligned substantially concentric with said valve seat in an axial spaced apart relationship thereto, a guide means positioned in said central aperture of said solenoid means, said guide means including a non-magnetic guide pin extending axially toward said valve seat substantially concentric therewith, an armature having a central axis aperture therein slidably positioned in said stepped bore of said body above said valve for abutment thereagainst with said guide pin slidably received in said aperture of said armature and a spring means operatively associated with said armature to normally bias said armature and therefore said valve in a direction to effect seating of said valve against said valve seat.

9. An electromagnetic fuel injector including a tubular housing means providing a fuel chamber therein intermediate its ends with said housing means having circumferentially spaced apart radial ports extending therethrough in fluid communication with said fuel chamber, a fuel injection nozzle means positioned in said housing means at one end thereof, said fuel injection nozzle means having at one end thereof a spray tip passage means for the discharge of fuel from said housing means and a flow passage at its other end opening into said fuel chamber, a ball valve means positioned in said fuel chamber for movement relative to said flow passage to control flow from said fuel chamber to said flow passage, a solenoid coil means fixed to the opposite end of said housing means in spaced axial relation to said fuel injection nozzle means with said fuel chamber therebetween, a core inside said coil means and magnetized by said coil means when said coil means is energized, an armature slidable inside said coil means in position to have one end thereof engaging said ball valve means and having its end next adjacent to said core spaced from said core when said ball valve means is in a closed position relative to said flow passage, the end of said core next adjacent to said armature having at least one transverse open slot therethrough, a return spring positioned to act on said armature in a direction moving said armature to effect movement of said ball valve means to its closed position with respect to said flow passage and a spring positioned in said fuel injection nozzle means to act on said ball valve means in a direction to bias said ball valve means in an opening direction relative to said flow passage.

10. An electromagnetic fuel injector including a tubular housing means providing a fuel chamber therein intermediate its ends with said housing means having circumferentially spaced apart radial ports extending therethrough in fluid communication with said fuel chamber, a fuel injection nozzle means positioned in one end of said housing, said fuel injection nozzle means including a spray tip with an axial swirl chamber-spray passage means therethrough for injection of fuel from said housing means, a seat element with a flow passage therethrough opening into said fuel chamber and an intermediate director means having inclined, radial director passages for effecting fluid communication between said flow passage and said swirl-spray passage means, a truncated ball valve positioned in said fuel chamber for operative movement relative to said flow passage to control flow from said fuel chamber to said flow passage, a solenoid coil means fixed to the opposite end of said housing means, a core inside said coil means and magnetized by said coil means when said coil means is energized, said core being positioned a predetermined axial distance from said seat element, an armature of predetermined axial extent slidably positioned inside said coil means and having its end next adjacent to said core spaced from said core a predetermined distance when said truncated ball valve is closed relative to said flow passage, the opposite end of said armature extending into said fuel chamber for engagement with the truncated side of said truncated ball valve, said end of said core next adjacent to said armature having a transverse open slot therethrough, a return spring positioned to act on said armature in a direction moving said armature to effect movement of said truncated ball valve to its closed positioned with respect to said flow passage and a valve spring positioned in said fuel injection nozzle means to bias said truncated ball valve in an opening direction relative to said flow passage.

11. An electromagnetic fuel injector according to claim 10 wherein said director means includes an upstanding boss loosely projecting into said flow passage a predetermined axial distance whereby to reduce the effective volume of said flow passage, and wherein said valve spring is positioned in said flow passage to encircle said upstanding boss to be centered thereby.

12. An electromagnetic fuel injector including a housing means providing a fuel chamber therein intermediate its ends with said housing means having diametrically opposed radial ports extending therethrough in fluid communication with said fuel chamber, a fuel injection nozzle means positioned in one end of said housing means including in succession extending from said one end a spray tip with a central axial spray passage means for the discharge of fuel from said housing means, a director means having director passages therethrough and a seat element with a central flow passage therethrough that opens at one end into said fuel chamber and which at its opposite end is in fluid communication with one end of each of said director passages, the opposite end of each of said director passages being positioned to impel fluid substantially tangentially into said spray passage whereby a whirling motion is imparted to the fluid, a truncated ball valve positioned in said fuel chamber for movement relative to said flow passage to control flow from said fuel chamber to said flow passage, a solenoid coil means fixed to the opposite end of said housing, a core positioned inside said coil means and magnetized by said coil means when said coil means is energized, an armature slidable inside said coil means and extending into said fuel chamber for engagement with the truncated side of said truncated ball valve, said armature having its end next adjacent to said core spaced from said core when said truncated ball valve is in a closed position relative to said flow passage, said end of said core next adjacent to said armature having a transverse open slot therethrough, a return spring positioned to act on said armature in a direction moving said armature to effect movement of said truncated ball valve to said closed position with respect to said flow passage and a valve spring positioned in said flow passage to abut at one end against said director means and at its other end against said truncated ball valve to bias said truncated ball valve in an opening direction relative to said flow passage.

13. An electromagnetic fuel injector according to claim 12 wherein said director means includes an upstanding boss loosely projecting into said flow passage a predetermined axial distance whereby to reduce the effective volume of said flow passage, and wherein said valve spring is positioned in said flow passage to encircle said upstanding boss to be centered thereby.

14. An electromagnetic fuel injector including a hollow tubular body with a stepped bore therethrough, spray discharge means fixed in said stepped bore at one end of said body to provide in succession extending from said one end a spray tip with a central spray passage therethrough, a director means having axially and radially inclined director passages therethrough each opening tangentially into said spray passage of said spray tip and a seat element with a central axial aperture therethrough providing at the end thereof opposite said director an annular valve seat, said aperture of said seat element being in fluid communication with the opposite end of said director passages, a semispherical ball-like valve positioned in said stepped bore for movement into and out of engagement with said valve seat, first spring means positioned in said spray discharge means in abutment against said valve to normally bias said valve in a direction out of engagement with said valve seat, a solenoid means fixed in said stepped bore at the opposite end of said body, said solenoid means having a central aperture therethrough that is internally threaded adjacent said opposite end, said central aperture being aligned concentric with said valve seat in an axial spaced apart relationship thereto, a guide means including an externally threaded adjusting screw positioned in adjustable threaded engagement in said central aperture of said solenoid means, said guide means further including a guide pin extending axially from said adjusting screw toward said valve seat concentric therewith, an armature having an axial aperture therein slidably positioned in said stepped bore of said body between said valve and said guide means with said guide pin slidably received in said aperture of said solenoid armature, said solenoid armature forming with the interior of said body, as defined by a portion of said stepped bore, an annular fuel chamber terminating at said valve seat, and second spring means encircling said guide pin in abutment against said armature to normally bias said armature and therefore said valve in a direction to effect seating of said valve against said valve seat against the biasing force of said first spring means, said body having opposed radial port apertures therethrough opening into said fuel chamber for the flow of fuel through said fuel chamber, said solenoid means having electrical teriminal means connectable to an electrical circuit.

15. An electromagnetic fuel injector according to claim 14 wherein said director means includes an upstanding boss extending into said aperture of said seat element to center said first spring means and to effectively reduce the flow volume of said aperture.

* * * * *

UNITED STATES PATENT AND TRADEMARK OFFICE

CERTIFICATE OF CORRECTION

PATENT NO. : 4,218,021
DATED : August 19, 1980
INVENTOR(S) : James D. Palma

It is certified that error appears in the above-identified patent and that said Letters Patent are hereby corrected as shown below:

Column 10, line 22, "125" should read -- 124 --.

Column 13, line 37, "perihperal" should read -- peripheral --.

Column 14, line 11, "encircile" should read -- encircle --.

Column 17, line 10, after "bounce" delete "and".

Column 18, line 27, "63" should read -- 163 --.

Column 20, line 25, "sperical" should read -- spherical --;

Column 20, line 49, "annuar" should read -- annular --;

Column 20, line 65, "vave" should read -- valve --.

Signed and Sealed this

*Thirteenth* Day of *January 1981*

[SEAL]

*Attest:*

SIDNEY A. DIAMOND

*Attesting Officer*

*Commissioner of Patents and Trademarks*